US005081740A

United States Patent [19]

Smith

[11] Patent Number: 5,081,740

[45] Date of Patent: Jan. 21, 1992

[54] RECONFIGURABLE SLIDE FOR MOVING FURNITURE

[76] Inventor: Terry C. Smith, 16435 SE. 34th St., Bellevue, Wash. 98008

[21] Appl. No.: 600,863

[22] Filed: Oct. 22, 1990

[51] Int. Cl.[5] ..... A47B 91/06

[52] U.S. Cl. ..... 16/42 R

[58] Field of Search ..... 16/42 R

[56] References Cited

U.S. PATENT DOCUMENTS 1,173,538 2/1916 Roberts ..... 16/42 R
3,326,508 10/1965 Born ..... 16/42 R
3,883,923 5/1975 England ..... 16/42 R

*Primary Examiner*—Robert L. Spruill
*Assistant Examiner*—Carmine Cuda
*Attorney, Agent, or Firm*—David L. Tingey

[57] ABSTRACT

A reconfigurable slide for supporting furniture being moved on common floor coverings is described. The slide, large relative to a furniture leg, comprises an inflexible slide cup of slippery material in contact with the floor covering which evenly distributes weight of the furniture over a broad area to minimize pressure on the floor covering. The slide further comprises a replaceable and reusable resilient slide cup insert fitted to the slide cup that has a flat upper surface which collapses around a furniture leg placed thereon, providing resistance to sliding of the leg on the insert. The resilient slide cup is made of closed-cell rubber that does not accumulate furniture damaging moisture and, with its increased density, provides better support of furniture than does sponge rubber. A second replaceable and reusable slide cup insert is provided, also fitted to the slide cup and with a flat upper surface, that is rigid for supporting furniture without legs while distributing furniture weight evenly to the floor contact area of the slide cup.

7 Claims, 1 Drawing Sheet

5

RECONFIGURABLE SLIDE FOR MOVING FURNITURE

BACKGROUND OF THE INVENTION

The present invention relates to slides useful in moving large furniture, major household appliances, file cabinets, entertainment consoles, or the like on a variety of floor coverings such as vinyl, carpet or wood.

It is well known in the art to have slidable casters for moving furniture. For example, Schacht, U.S. Pat. No. 1,861,095, teaches a caster cup having a slidable shell filled with a resilient body material which is configured with various recesses and friction enhancement schemes to prevent a furniture leg from moving within the caster cup. Also, Born, U.S. Pat. No. 3,326,508, teaches a slide with a flat but flexible sliding shoe supporting a body permanently affixed to the shoe upper surface at its center. The Born slide body, either of rigid or resilient material, has a pressure-sensitive material to permanently affix the slide to furniture. The slide shoe, which concentrates furniture weight at its center, deforms to a dish shape under weight of the furniture at its center to lift the perimeter of the shoe above a floor surface to reduce edge grasping. The shoe may also be dished initially to accentuate the effect.

The present invention provides a reconfigurable slide, not previously known, that is reusable in moving furniture which is large relative to a furniture leg. It uses a round slide cup with a rigid, flat floor contact surface to distribute furniture weight over its large floor contact surface and rounded corners to avoid edge grasping. A replaceable insert is used in the slide cup for adapting the slide for various applications. It is also not known to have an insert used in combination with the slide cup which, first, has a bottom surface that matches the contour of the cup inner surface to prevent sliding without the use of adhesives and, second, which also has a uniformly flat top surface either of resilient material to conform to virtually any furniture leg or of rigid material useful for moving furniture not having a leg.

BRIEF DESCRIPTION OF THE INVENTION

It is the primary object of the present invention to provide a slide with a bottom surface rigid and large relative to a furniture leg to protect floor surfaces from damage by distributing furniture weight over a broad area.

A second object is to provide a plurality of replaceable inserts, one of which is selected and removably placed in the slide cup to enable the slide to be reconfigured for use with a variety of furniture items.

A third object is to provide a replaceable rigid insert useful for structures without legs.

A fourth object is to provide a replaceable resilient insert to accommodate virtually any size or shape furniture leg or caster, collapsing around it to provide resistance to sliding of the leg or caster within the insert.

Another object is that the slide cup have rounded corners at the boundaries of the floor contact surface to facilitate sliding over floor irregularities and carpet.

Still another object is to provide a replaceable insert that is retained in a slide cup without moving yet without use of adhesives such that the insert cup can be easily and quickly replaced to accommodate a variety of applications.

A final object is to provide a resilient insert made of closed cell rubber to provide resistance to sliding and to prevent moisture accumulation which could damage furniture finishes.

In obtaining these objectives, the present reconfigurable slide for moving furniture comprises an inflexible shell cup with a floor contact area large relative to a furniture leg or caster typically 4 inches to 8 inches in diameter and ⅛ inch in thickness. The cup is also round to facilitate movement in any direction or change in direction. The cup also has a curvilinear surface transitioning its bottom surface to its side surfaces at its perimeter to facilitate movement over floor irregularities and carpet and to avoid edge grasping of the floor covering. The cup is made of polyethylene or similar material that is inflexible under most household loads yet facilitates sliding with its naturally slippery surface without marring the floor covering.

In the slide cup is a replaceable insert matching the shape of the cup inner surface at its bottom surface and is uniformly flat at its upper surface. The slide with slide cup and slide cup insert is typically about ¾ inch in height above the floor surface.

A first insert is made of resilient rubber to receive furniture leg structures of virtually any shape and, specifically, of closed-cell rubber to additionally resist moisture accumulation which causes damage to finishes on furniture, particularly those with wood finishes. The closed-cell rubber also is more dense than typical open cell, porous rubber, such as sponge rubber, and therefore provides better support of the structure leg than sponge rubber which tends to completely compress even under light loads, effectively providing little actual support for the load. As the closed-cell rubber insert compresses under the leg, it also collapses around the side of the leg. This provides resistance to furniture leg sliding in the cup, this without adhesives, recesses in the insert, or special structures in the cup to contain the leg.

A second removable insert is made of a rigid material such as hard plastic and extends vertically at least as high as the sides of the slide cup. This rigid insert is useful for moving structures without legs. The insert flat upper surface is in face-to-face contact with the furniture, and the insert bottom surface is shaped to match the inflexible cup distributing the weight of the structure over the floor contact area of the cup. With the reduced pressure from broad weight distribution, the structure is able to be moved with moderate thrust and without marring a floor covering.

A third insert may be a carpet plug closely fitted into the slide cup. The polypropylene backing typical of carpets provides a nonsliding surface to interface the insert with the slide cup. Upper carpet fabric with the backing provides support characteristics inherent in household carpets. Carpet chosen for use as an insert typically matches the carpet floor covering found in the area of use so that the slide is more aesthetic and unobtrusive.

To protect the inserts and for ease in cleaning the slide, a cloth insert cover may be removably fitted to the insert upper surface.

DESCRIPTION OF THE PREFERRED EMBODIMENTS

Figure 1:
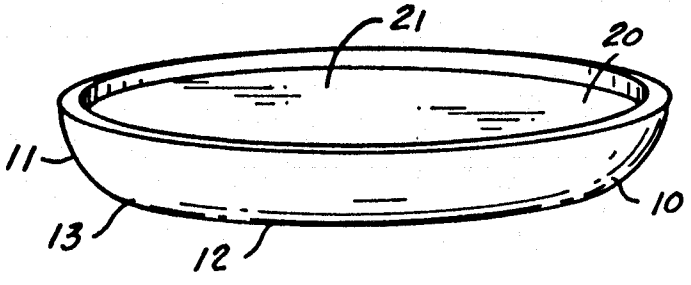
FIG. 1 is a perspective view of a slide with resilient insert.

Referring to the figures, in its usual configuration slide 5 of the present invention comprises an inflexible slide cup 10 and a removable slide cup insert 20.

Slide cup 10 has sides 11 extending upward, floor contact area 12, rounded corners 13 joining the floor contact area 12 with sides 11 at the perimeter of the floor contact area 12, and cup inner surface 14.

Figure 2:
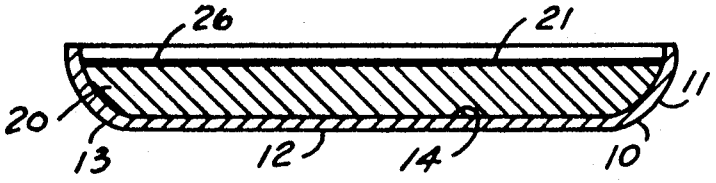
FIG. 2 is a vertical section of the slide of FIG. 1.

As shown in FIG. 1 and FIG. 2, replaceable closed-cell rubber cup insert 20 has a flat upper surface 21 and a insert bottom surface 22 formed to match cup inner surface 14 with insert side surface 23 extending upward in the cup to restrain insert movement without adhesives. The insert height is typically, but not necessarily, less than cup sides 11 so that should the closed-cell rubber insert not stop movement of a furniture leg in the insert, the leg will be stopped by the rigid cup side.

Figure 3:
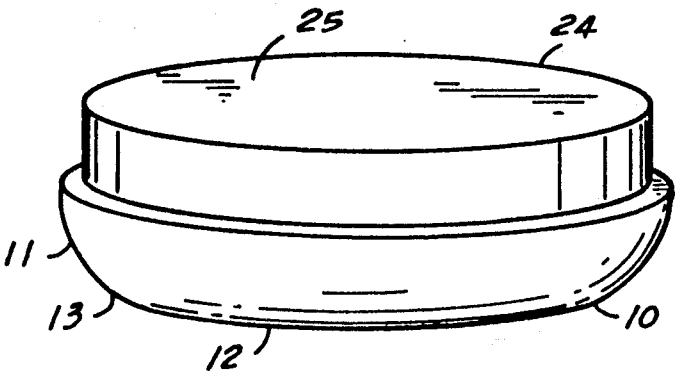
FIG. 3 is a perspective view of the slide showing a rigid insert extending above the slide cup.
Figure 4:
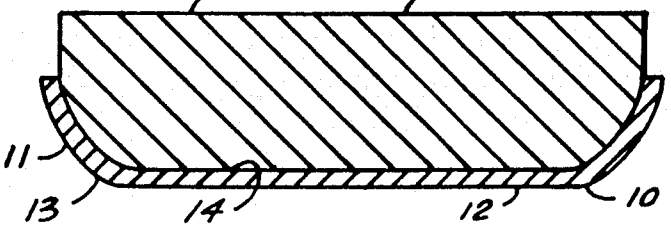
FIG. 4 is a vertical section of the slide of FIG. 3.

As shown in FIG. 3, replaceable rigid cup insert 24 with flat upper surface 25 extends above sides 11 of cup 10 to support an object with no legs.

Figure 5:
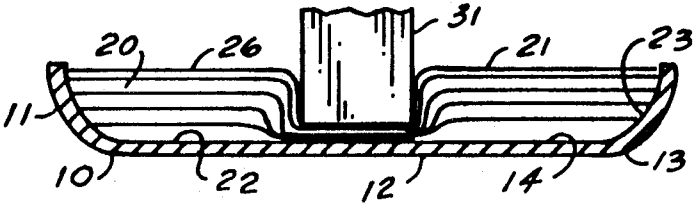
FIG. 5 is a vertical section view of the slide of FIG. 1 supporting a furniture leg.

As shown in FIG. 2 and in FIG. 5, a cloth insert cover 26 is removably fitted to the insert upper surface to protect the inserts and for ease in cleaning the side.

Figure 6:
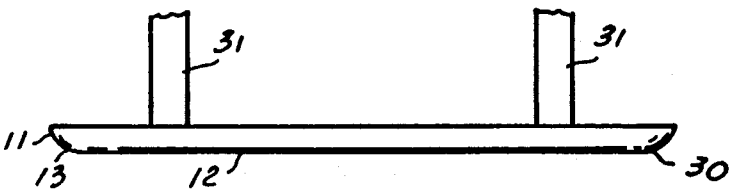
FIG. 6 is a perspective view of an elongated slide supporting two furniture legs.

In an alternative embodiment as shown in FIG. 6, slide 30 may be elongated to support more than one furniture leg 31, allowing delicate furniture to be moved without inducing strains in furniture leg during movement.

I claim:

1. A reconfigurable slide for placement under a furniture leg to facilitate sliding on a floor surface comprising in combination a rigid slide cup having a uniformly flat bottom surface and upwardly extending side surfaces with a curvilinear surface transitioning its bottom surface to its side surfaces to facilitate movement over floor irregularities and a corresponding inner surface and a removable rigid insert in the slide cup having a uniformly flat upper surface extending vertically beyond the slide and having a contoured surface matching a slide cup inner surface so that the slide cup and the insert are uniformly in face-to-face contact over the cup inner surface to resist sliding of the insert in the slide cup and so that support of furniture is evenly distributed over the slide.

2. A reconfigurable slide for placement under a furniture leg to facilitate sliding on a floor surface comprising in combination a rigid slide cup having a uniformly flat bottom surface and upwardly extending side surfaces with a curvilinear surface transitioning its bottom surface to its side surfaces to facilitate movement over floor irregularities and a corresponding inner surface, and a removable insert in the slide cup made of resilient rubber having a uniformly flat upper surface for receiving a furniture leg around which the insert collapses to resist sliding of the leg in the insert and having a contoured surface matching the slide cup inner surface so that the slide cup and the insert are uniformly in face-to-face contact over the cup inner surface to resist sliding of the insert in the slide cup.

3. The invention of claim 2 wherein the insert is made of closed-cell rubber.

4. The invention of claim 1 or claim 2 wherein the slide cup is made of polyethylene or similar material that is rigid under typical household loads yet facilitates sliding with a naturally slippery surface without marring a floor surface.

5. The invention of claim 1 or claim 2 further comprising a cloth insert cover removably fitted over the insert upper surface and between the insert and the furniture leg received by the insert to protect the insert and for ease in cleaning the slide.

6. The invention of claim 1 or claim 2 wherein the slide cup is elongated to support more than one furniture leg.

7. The invention of claim 1 or claim 2 wherein the slide cup is round to facilitate sliding movement in any direction.

* * * * *